US005608936A

United States Patent [19]

Nomura

[11] Patent Number: 5,608,936

[45] Date of Patent: Mar. 11, 1997

[54] FLEXIBLE RESIN FILLED CUSHION PERMITTING DRAINAGE

[75] Inventor: Kiyoshi Nomura, Kaiduka, Japan

[73] Assignee: Yamaichi Co., Ltd., Osaka, Japan

[21] Appl. No.: 530,412

[22] Filed: Sep. 19, 1995

[51] Int. Cl.[6] ..... A47G 9/00

[52] U.S. Cl. ..... 5/645; 5/652.1; 5/948

[58] Field of Search ..... 5/448, 436, 912, 5/911, 652, 455, 645, 638, 652.1, 948

[56] References Cited

U.S. PATENT DOCUMENTS 74,340 2/1968 Gilbert ..... 5/455

4,924,541 5/1990 Inagaki ..... 5/636

5,152,019 10/1992 Hirata ..... 5/448

FOREIGN PATENT DOCUMENTS 17534 9/1888 United Kingdom ..... 5/448

*Primary Examiner*—Alexander Grosz

*Attorney, Agent, or Firm*—Armstrong, Westerman, Hattori, McLeland & Naughton

[57] ABSTRACT

A pillow has a bag which is made of mesh or the like and fully filled with filling materials, each of which is made of a flexible resin, has a hollow configuration such as a hollow sphere or a hollow body and made of a flexible resin and has two or more openings on its surface.

8 Claims, 5 Drawing Sheets

FLEXIBLE RESIN FILLED CUSHION PERMITTING DRAINAGE

BACKGROUND OF THE INVENTION

1. Field of the Invention

The present invention relates to a filling material filled in a pillow or other supports for cushion-type comfort and a pillow filled with the filling materials. More particularly, the pillow has preferable air permeability and heat dissipation properties; it is not heated by heat from a human body so as to be comfortably used, and it can be washed by water, easily dried and always used in a clean state.

2. Description of the Prior Art

Conventionally, buckwheat chaff, rice chaff, kapok, feathering, cotton, sponge or the like have been generally used in a pillow as its filling materials. More specifically, the filling materials are filled in a bag and the bag is put in a pillowcase.

However, air permeability of the pillow filled with the above filling materials is disadvantageous because heat from a human body is transferred to the pillow while a head is put on the pillow and the pillow is gradually heated because the heat is not dissipated from the pillow. In this case, it is very hard to sleep on the pillow or sweat generated on the pillow makes the pillow dirty, so that molds or bacteria could be generated, which is not preferable for reasons of sanitation.

According to the conventional pillow, when it becomes dirty, the pillowcase is taken out and only washed.

If the bag filled with the above filling materials is washed by water or the like, the filling materials in the bag are impregnated with a large amount of water or the like and it takes a lot of time to dry the bag. Furthermore, the filling material deteriorates because of the impregnation of water or the like.

Thus, the bag filled with the filling materials is only disinfected by sunning.

However, the dirty pillow can not be fully cleaned by sunning, and dust or the like stays in the bag. Consequently, ticks, bacteria or the like increase in the bag, which could cause an allergic disease.

In addition, the above conventional pillow has low elasticity in general. Therefore, when a head leaves the pillow, since the pillow is not fully elastically restored to its original configuration, the pillow remains depressed. In that case, it has to be restored to its original configuration when used again, which is troublesome.

SUMMARY OF THE INVENTION

It is the first object of the present invention to provide a pillow which is not gradually heated while a head is put thereon and can be used in sanitary and comfortable conditions without generation of molds or bacteria caused by sweat on the pillow because of its preferable air permeability and heat dissipation properties.

It is the second object of the present invention to provide a pillow in which not only a pillowcase but also a bee filled with filling materials can be easily washed by water or the like and dried when it becomes dirty so as to be always used in a clean state and dust does not stay so that ticks, bacteria or the like are not generated.

It is the third object of the present invention to provide a pillow which can be fully restored to its original configuration by filling materials when a head leaves the pillow.

According to the present invention, the filling material filled in a pillow is hollow and made of a flexible resin and has two or more openings on its surface.

In this embodiment of the present invention, the flexible resin used as the filling material can be a material such as flexible polyethylene which shows high flexibility and elasticity. Furthermore, rubber or the like may be admixed to the material in order to improve its flexibility and elasticity.

In addition, the above filling material may have various hollow configurations such as a hollow sphere or a flat and hollow box. The flexibility or elasticity of the filling material can be adjusted by adjusting a size, a configuration and a thickness of the filling material or adjusting a size of the opening provided on the filling material.

Furthermore, an anti-fungus agent, an aromatic agent, a deodorant or the like can be admixed to the flexible resin of the filling material as an additive.

Still further, although various kinds of bags can be used as the bag to be filled with the filling materials, it is preferable that the bag is made of mesh from which the filling materials may not escape so that the bag can be easily dried when washed by water or the like.

Thus, according to the pillow having a bag fully filled with the filling materials, each of which is hollow and made of the flexible resin and has two or more openings on its surface, since air passes through the filling materials through the openings provided on the filling material, the pillow has a preferable air permeability. In addition, air in the filling materials is exchanged when it is deformed and elastically restored to its original configuration. Therefore, even if heat is transferred to the pillow from a human body while it is used, since the heat can be dissipated outside from the pillow because air flows through the filling materials and air in the filling material is exchanged, the pillow is not likely to be heated up. Consequently, the pillow can be used in a comfortable condition. In addition, there is no generation of molds nor bacteria in the pillow caused by sweat on the pillow while it is used, whereby the pillow can be used in a sanitarily preferable state.

Furthermore, according to the pillow of the present invention, even if the hollow filling material contains water or the like while the bag fully filled with the filling materials is washed by water or the like, since water or the like can easily flow out through the openings provided on the filling material by shaking the bag several times, the bag can be easily dried and the pillow can be always used in a clean state. Furthermore, in the case where the bag is made of mesh, water or the like can be more effectively drained from the bag, whereby the bag can be dried for a shorter time.

In addition, according to the pillow of the present invention, since the filling material in the bag elastically deforms, the pillow can be elastically restored to its original configuration by the filling materials after a head leaves the pillow. Therefore, when the pillow is used again, it is not necessary to restore the pillow to the original configuration. Furthermore, since the filling material has a preferable elasticity, the head or neck touching the pillow receives a proper amount of impetus, which can be an effect of a massage.

Furthermore, according to the pillow of the present invention, since elasticity of the filling material can be adjusted by changing a size, a configuration and a thickness of the filling material filled in the bag and a size of an opening, various tastes of touch in the pillow can be easily obtained.

These and other objects and advantages of the present invention will be more fully apparent from the following detailed description.

PREFERRED EMBODIMENT OF THE PRESENT INVENTION

Embodiment 1

Figure 1:
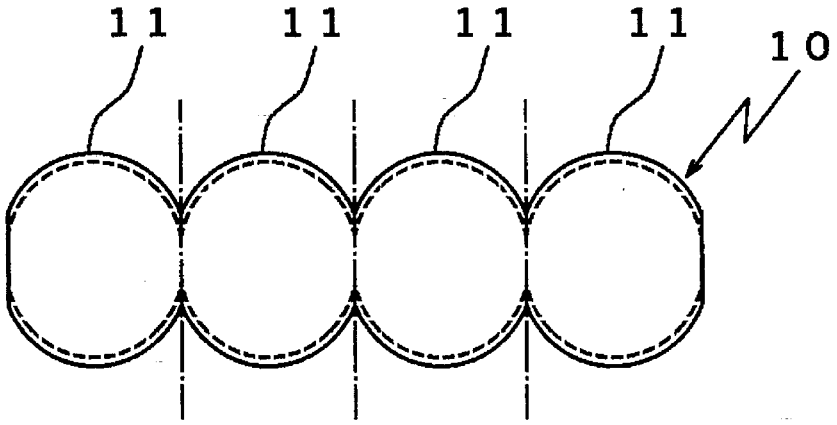
FIG. 1 is a plan view showing a state of manufacturing a filling material used in a pillow according to an embodiment 1 of the present invention.
Figure 2:
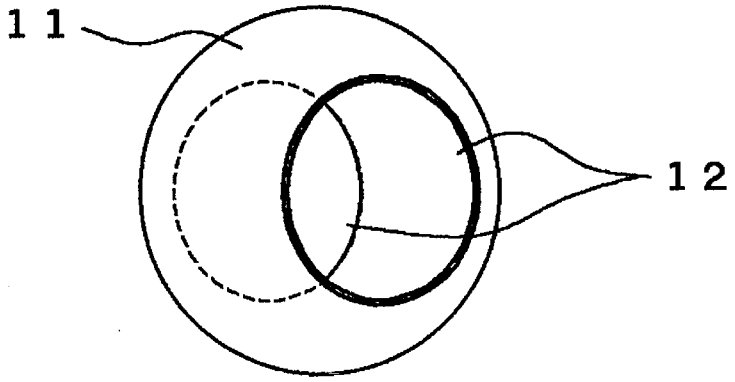
FIG. 2 is a perspective view showing the filling material used in the pillow according to the embodiment 1 of the present invention.

According to this embodiment of the present invention, a flexible polyethylene resin is used as a filling material. It maybe extruded from a molding machine to obtain a tube of the flexible polyethylene resin. Then, the tube is introduced into a mold and vacuum suction is performed in the mold. Then, a tube 10 in which hollow spheres are continuously formed is molded as shown in FIG. 1 and connecting parts of the hollow spheres are cut. Thus, there is provided a filling material 11 which is a hollow sphere and has a pair of openings 12 oppositely formed on its peripheral surface as shown in FIG. 2.

The filling material 11 is 11.5 mm in diameter and the opening 12 is 5.5 mm in diameter and 0.5 mm in thickness.

Figure 3A:
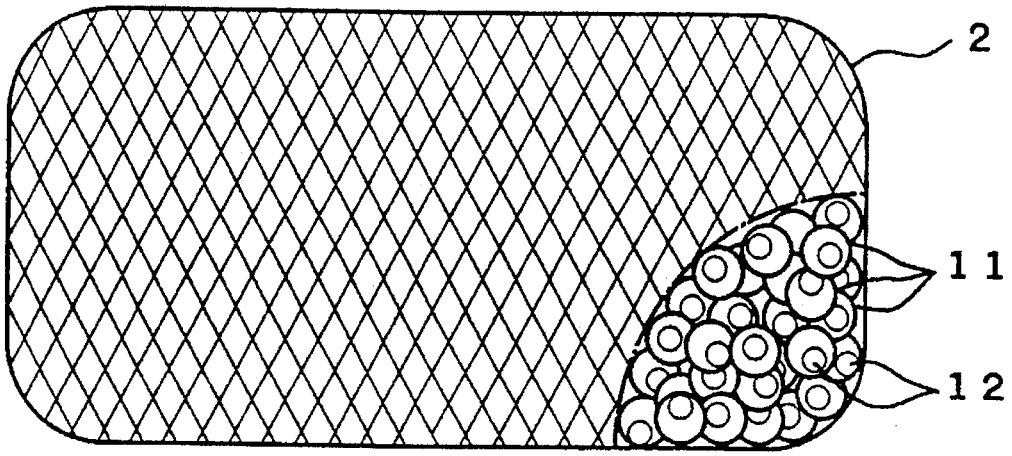
FIG. 3(A) is a schematic plan view and FIG. 3(B) is a schematic side view showing a state in which the filling materials are fully filled in a mesh bag of the pillow according to the embodiment 1 of the present invention.
Figure 3B:
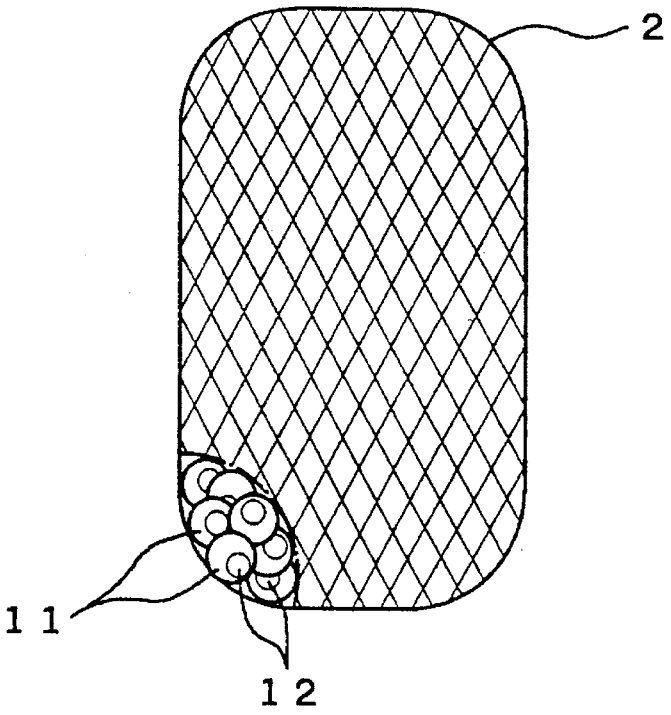
Figure 4:
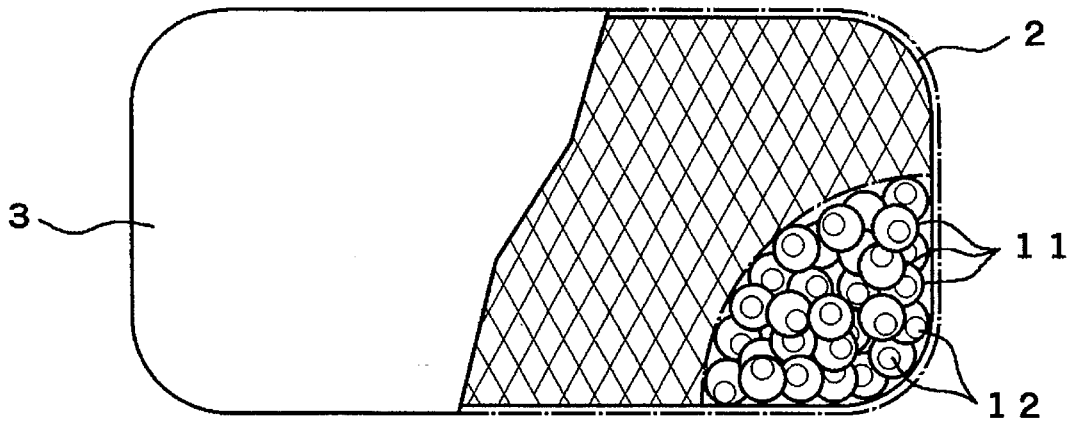
FIG. 4 is a schematic view showing a state in which the bag is put in a pillowcase of the pillow according to the embodiment 1 of the present invention.

Thus, according to the pillow of this embodiment of the present invention, the thus obtained filling materials 11 are fully filled in a mesh bag 2 as shown in FIGS. 3(A) and 3(B) and a pillowcase 3 covers the mesh bag 2 filled with the filling materials.

Consequently, while the pillow of the present invention is used, even if heat from a human body is transferred to the pillow, since air flows in each filling material 11 through the pair of openings 12 formed on the filling material 11, the heat can be dissipated from the pillow and the pillow is not heated up. Therefore, sweat is not likely to be generated while the pillow is used, so that the pillow is not likely to become dirty and can be used in a comfortable condition.

In addition, when the pillow according to this embodiment of the present invention is washed, the pillowcase 3 is removed and washed and also the mesh bag 2 filled with the filling materials is washed by water or the like. Since water or the like contained in the filling materials 11 may be drained by shaking the bag 2 several. times, the bag can be easily dried. Thus, the bag 2 can be easily washed.

Furthermore, according to the pillow of this embodiment of the present invention, since the filling material 11 is hollow and has the pair of openings 12 on its surface, the filling material 11 has high elasticity and the head or neck touching the pillow receives a proper amount of impetus, which can be an effect of a massage.

Still further, when the pillow is used, the filling materials 11 filled in the bag 2 are smoothly moved in the bag 2 and elastically deformed, whereby the pillow is preferably deformed along the head and neck.

In addition, when the head leaves the pillow, the filling materials 11 deformed in the bag 2 are elastically restored to the original configuration and the filling materials 11 filled in the bag 2 are moved. Then, since the pillow is immediately restored to the original state, it is not necessary to restore the pillow to the original configuration

Embodiment 2

According to this embodiment of the present invention, similar to the embodiment 1 of the present invention, the flexible polyethylene resin is used as the filling material.

Figure 5:
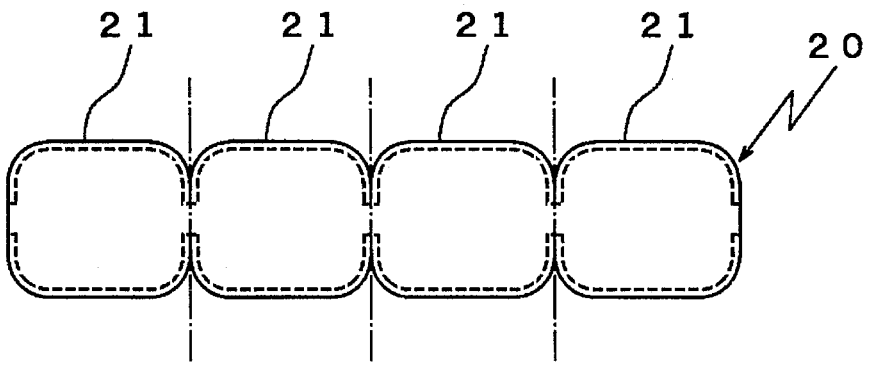
FIG. 5 is a plan view showing a state of manufacturing a filling material used in a pillow according to an embodiment 2 of the present invention.
Figure 6:
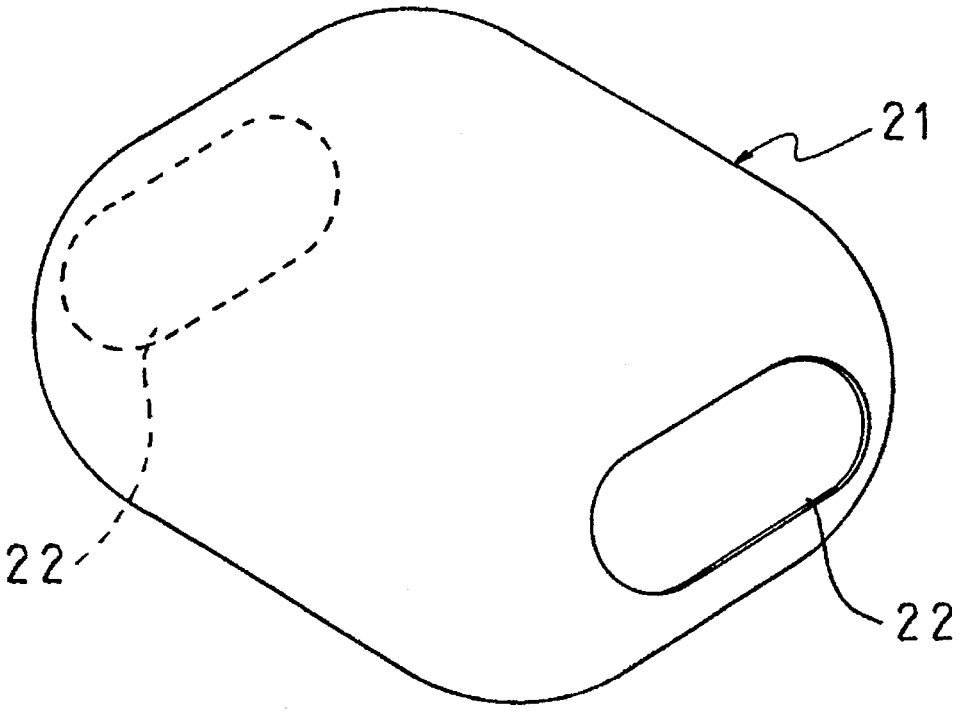
FIG. 6 is a perspective view showing the filling material used in the pillow according to the embodiment 2 of the present invention.

Then, according to this embodiment, the filling material is extruded from a molding machine to obtain a flexible polyethylene resin tube. Then, the tube is introduced into a mold and vacuum is performed in the mold. Thus, there is molded a tube 20 in which flat and hollow boxes 21 are continuously formed as shown in FIG. 5. Then, connecting parts of the hollow boxes 21 are cut and there is provided a flat and hollow box-shaped filling material 21 in which each corner is formed round and a pair of openings 22 is oppositely formed on its side surface.

Figure 7:
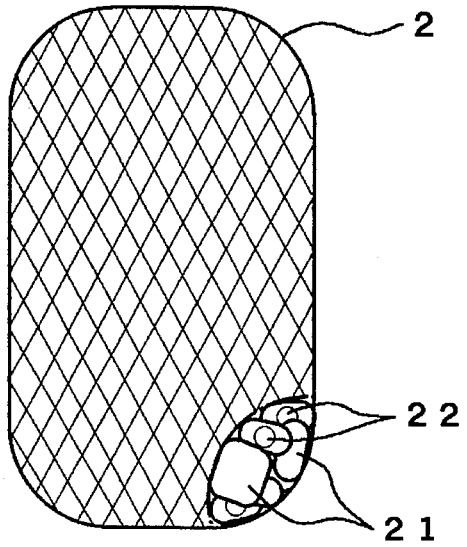
FIG. 7 is a schematic side view showing a state in which the filling materials are fully filled in a mesh bag of the pillow according to the embodiment 2 of the present invention.
Figure 8:
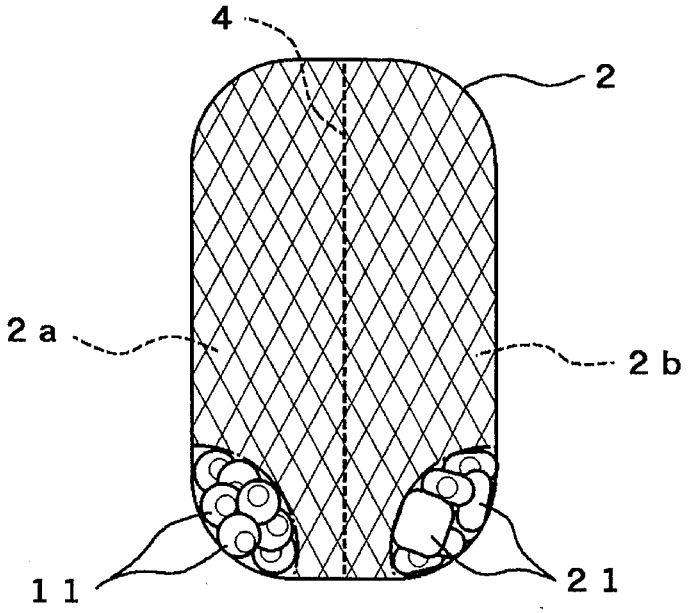
FIG. 8 is a schematic side view showing a state in which the mesh bag is separated to two parts and a kind of the filling materials filled into one part is different from that in the other part.

According to a pillow of this embodiment of the present invention, the thus obtained filing materials 21 are fully filled in the mesh bag 2 as shown in FIG. 7 and the mesh bag 2 filled with the filling materials 21 is covered by the pillowcase In the embodiment 2 of the present invention also, there can be provided the same effect as in the embodiment 1 of the present invention. In addition, according to the pillow of the embodiment 2 of the present invention, since the filling material 21 is more flexible than the hollow and spherical filling material 11 used in the embodiment 1 of the present invention, when the pillow is used, it is softer to the feel than the pillow in the embodiment 1 of the present invention.

Embodiment 3

According to this embodiment of the present invention, two kinds of filling materials 11 and 21, such as the hollow and spherical filling material 11 used in the embodiment 1 of the present invention and the flat and hollow box-shaped filling material 21 used in the embodiment 2 of the present invention are used.

According to a pillow of this embodiment, the mesh box 2 is separated into two front and back parts 2*a* and 2*b* by a partition material 4 as shown in 8 and the hollow and spherical filling materials 11 used in the first embodiment of the present invention are filled in one filling part 2*a*, while the flat and hollow box-shaped filling materials 21 used in the second embodiment of the present invention are filled in the other filling part 2*b*. Then, the mesh bag 2 filled with the filling materials 11 and 21 in the filling parts 2*a* and 2*b*, respectively is covered by the pillowcase 3.

Thus, there can be provided the same effect in the pillow according to the third embodiment of the present invention as in the first and second embodiments of the present invention.

In addition, according to the third embodiment of the present invention, since the hollow and spherical filling materials 11 are filled in the part 2*a* while the flat and hollow box-shaped filling materials 21 are filled in the part 2*b*, the pillow has two kinds of different touch. More specifically, when the part 2*a* filled with the hollow spherical filling materials 11 is placed on the upside of the pillow, a little harder touch is provided. Meanwhile, the part 2*b* filled with the flat and hollow box-shaped filling materials 21 is placed on the upside of the pillow, a soft touch can be provided. Therefore, the hard and soft touches can be both obtained only by turning the pillow over and the pillow can be favorably used.

In addition, although the flexible polyethylene resin is used as the filling material in the above embodiments of the present invention, the filling material is not limited to the above material and other flexible resin can be used. Furthermore, in order to obtain a softer touch in the pillow, rubber or the like may be admixed to the flexible resin so as to increase flexibility of the filling material.

In addition, generation of bacteria or the like in the pillow is suppressed by adding an anti-fungus agent into the flexible resin of the filling material as an additive and the pillow can be used in a more sanitary state. Furthermore, a bad smell in the pillow can be suppressed by adding an aromatic agent, a deodorant or the like into the flexible resin of the filling material as an additive and the pillow can be used in a more comfortable condition. Still further, the pillow can be more flexible and elastic by adding rubber or the like into the flexible resin of the filling material.

Various details of the invention may be changed without departing from its spirit nor scope. Furthermore, the foregoing description of the embodiments according to the present invention is provided for the purpose of illustration only, and not for the purpose of limiting the invention as defined by the appended claims and their equivalents.

What is claimed is:

1. A support for providing cushion-type comfort, comprising:

a bag; and a filling material filled in said bag, said filling material including a plurality of hollow pieces made of a flexible resin, each hollow piece including a shell wall having two or more openings therethrough, wherein each opening is large enough to enhance heat dissipation and water drainage, said shell wall has rounded portions adjacent to each opening such that said shell wall between said openings is curved convexly outward between said openings, and at least some of said plurality of hollow pieces are in the form of flat and hollow bodies having a generally flat region formed between said rounded portions at opposite sides thereof.

2. A support according to claim 1, wherein said resin includes at least one of an anti-fungus agent, an aromatic agent and a deodorant as an additive.

3. A support according to claim 1, wherein some of said plurality of hollow pieces are in the form of a hollow sphere.

4. A support according to claim 1, wherein said bag is separated into a plurality of parts and each part contains a different kind of filling material.

5. The support according to claim 4, wherein at least a first part of said plurality of parts contains hollow pieces in the form of hollow spheres and at least a second part of said plurality of parts contains hollow pieces in the form of said flat and hollow bodies.

6. The support according to claim 1, wherein said bag is made of mesh.

7. The support according to claim 1, wherein said bag and said filling material are a pillow.

8. The support according to claim 1, wherein all of said plurality of hollow pieces of said filling material are in the form of said flat and hollow bodies.

* * * * *